United States Patent [19]

Engdahl, Jr.

[11] 4,159,076

[45] Jun. 26, 1979

[54] SEALED END CARTON

[75] Inventor: Arnold B. Engdahl, Jr., Irvin, Calif.

[73] Assignee: Federal Paper Board Company, Inc., Montbale, N.J.

[21] Appl. No.: 889,270

[22] Filed: Mar. 23, 1978

[51] Int. Cl.[2] ..... B65D 5/02

[52] U.S. Cl. ..... 229/37 R

[58] Field of Search ..... 229/37 R

[56] References Cited

U.S. PATENT DOCUMENTS

| | | | |
|---|---|---|---|
| 2,670,128 | 2/1954 | Stowitts | 229/37 R |
| 3,094,265 | 6/1963 | Hovland | 229/37 R |
| 3,140,809 | 7/1964 | Hickin et al. | 229/37 R |
| 3,229,890 | 1/1966 | Wright | 229/37 R |
| 3,348,757 | 10/1967 | Hickin et al. | 229/37 R |
| 3,357,629 | 12/1967 | Smith | 229/37 R |
| 3,586,233 | 6/1971 | McCulloch | 229/37 R |
| 3,934,791 | 1/1976 | Dick et al. | 229/37 R |
| 3,985,287 | 10/1976 | Stetler | 229/37 R |

*Primary Examiner*—Davis T. Moorhead
*Attorney, Agent, or Firm*—Guy A. Greenawalt

[57] ABSTRACT

A rectangular tubular carton of foldable sheet material having a sealed end closure which comprises end closure panels hinged on oppositely disposed sidewalls, which are of a size to close the open end, with the innermost one having a narrow hinged panel on its free edge which is adhesively secured to the inside face of the outermost closure panel and folded into engagement with the innermost panel and hinged dust flaps on the other two sidewalls which are notched out along the one edge to accommodate the edge panel when it is folded back onto the innermost closure panel, the dust flaps being interposed between the closure panels. In a modified form, small end panels are hinged to the outermost closure panel and secured against the outside top margins of the sidewalls which have the dust flaps.

2 Claims, 13 Drawing Figures

SEALED END CARTON

This invention relates to packaging and is more particularly concerned with improvements in packaging containers which are adapted to be fabricated from paperboard or similar foldable sheet or web material and which are particularly suitable for packaging materials of a character requiring a tightly sealed container.

In the packaging of various materials of a flowable nature, such as, for example, food products, especially when prepared for freezing, fine grained granular materials and the like, tubular containers which are formed of paperboard or other foldable sheet or film material are frequently employed, with some arrangement for tight sealing so as to prevent leakage. Generally, the tubular containers are rectangular in cross section and have an end closure arrangement which comprises inner dust flaps hinged to narrow sidewall ends and outer closure flaps hinged to wider sidewall ends with the latter adapted to close on the dust flaps in overlying and overlapping relation. In such an arrangement it becomes difficult to obtain a tight seal which is leak proof, particularly, in effecting the final end closing which occurs after the container has had one end sealed, usually on a forming mandrel, and the product has been placed in the same, since there is no adequate support for the innermost flaps to insure contact with the overlying outer flaps while the adhesive is set or dried. The containers are seldom filled to full capacity and the innermost flaps which are first folded into the container frequently drop into the container so as to be out of contact with the overlying outer flap, or there is too little contact and an effective seal is not obtained. Various end constructions have been suggested for obtaining the desired leak proof sealing of the end closure panels, such as, the use of suction arrangements for holding the inner flaps in contact with the outer closure panels while the adhesive dries or sets, foldable corner webs for connecting the edges of the flaps with the adjoining panels, and embossing arrangements designed to obtain seating in cut-out areas. However, many of the suggested arrangements have not been acceptable for one reason or another, generally because a seal of satisfactory tightness is not obtained or the use of special machinery is required.

A general object of the present invention is to provide a tubular container or carton structure, formed of paperboard or similar foldable sheet material, which is provided with end closure panels or flaps adapted to be adhesively secured in such a manner that a satisfactory, tight, leak proof seal results.

A more specific object of the invention is to provide a container which is formed of paperboard, or other suitable foldable sheet material, with hinged end closure flaps which are brought into interengaging face contacting relation and adhesively secured, with little or no exposure of raw edges which are likely to absorb grease, oil, or other fluid material, and result in discoloration, so as to injure the appearance or render the adhesive ineffective.

A further object of the invention is to provide a tightly sealed tubular container or carton which is adapted to be formed of paperboard, or similar material, with an end closure arrangement comprising hinged closure flaps which are adapted to be folded into face engaging closure forming relation and adhesively secured on conventional carton forming and closing machinery, without the need for any extensive alternation of the machinery.

A still further object of the invention is to provide a tubular container which may be formed of paperboard, or similar foldable material, with end closure panels which are hinged to the sidewalls and constructed so that they may be interleaved and adhesively secured to each other in tightly sealed end closing relation.

To this end the invention, as disclosed and claimed herein, comprises a tubular carton structure of paperboard, or similar foldable sheet material, having end closure panels hinged to the edges of the carton sidewalls which are adapted to be closed with an innermost panel being hinged to the edges of oppositely disposed sidewalls which affords a substantially complete closure of the otherwise open end of the carton and with the remaining panels interleaved and adhesively secured so that the outermost closure panel provides an outer cover on the end of the carton.

The aforesaid objects and other objects and advantages of the invention will become more apparent when reference is made to the accompanying detailed description of the preferred embodiment of the invention which is set forth therein, by way of example, and shown in the accompanying drawings wherein like reference numerals indicate corresponding parts throughout.

Figure 1:
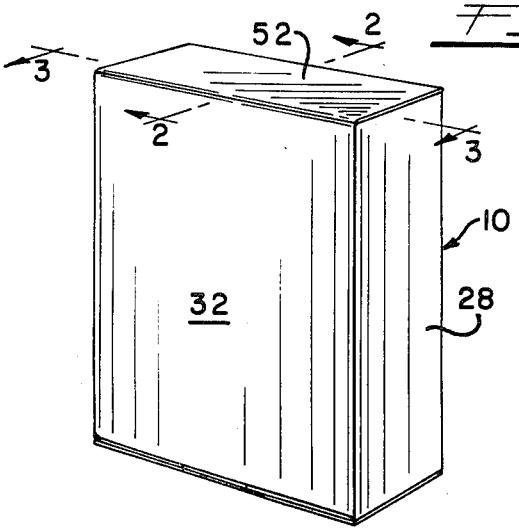
FIG. 1 is a perspective view of a carton in set-up and closed condition which embodies the principle features of the invention.
Figure 2:
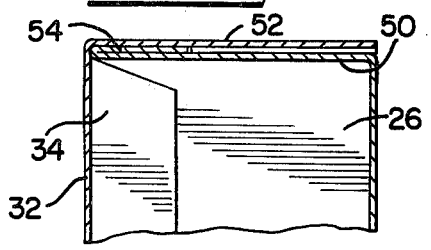
FIG. 2 is a cross sectional view, to an enlarged scale, taken on the line 2—2 of FIG. 1, and showing the top end portion of the carton.
Figure 3:
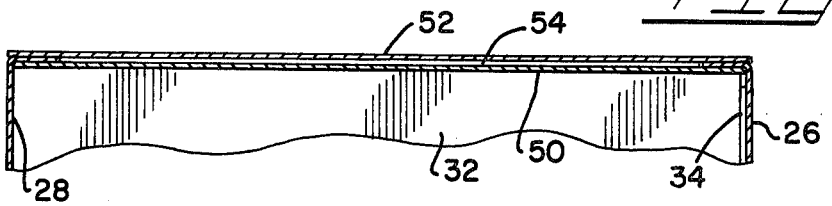
FIG. 3 is a cross sectional view, to an enlarged scale, taken on the line 3—3 of FIG. 1.
Figure 5:
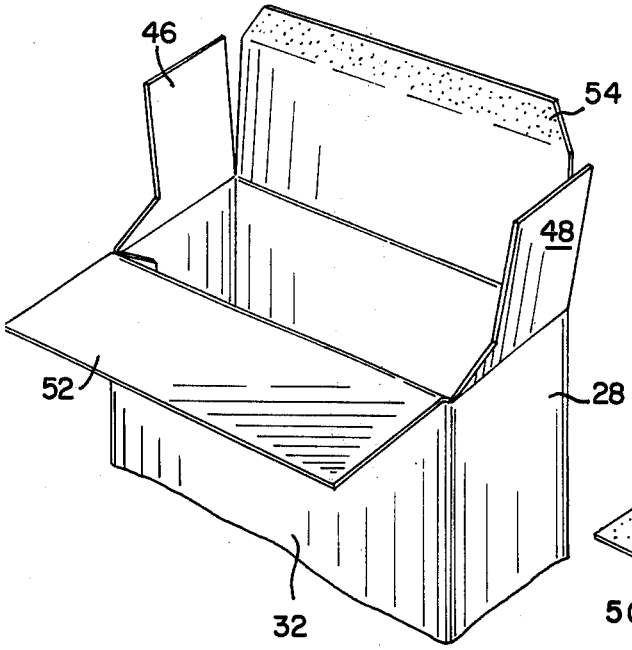
FIG. 5 is a fragmentary perspective view showing the top end portion of the carton of FIG. 1 with the end closure panels in open position.
Figure 6:
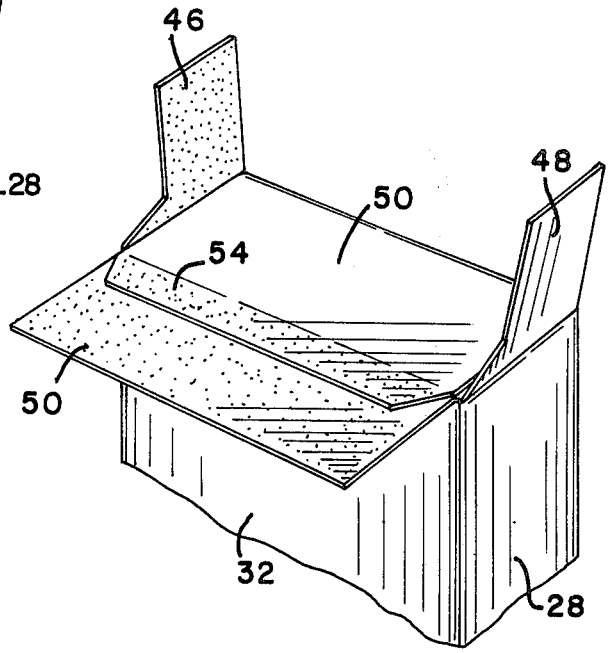
Figure 7:
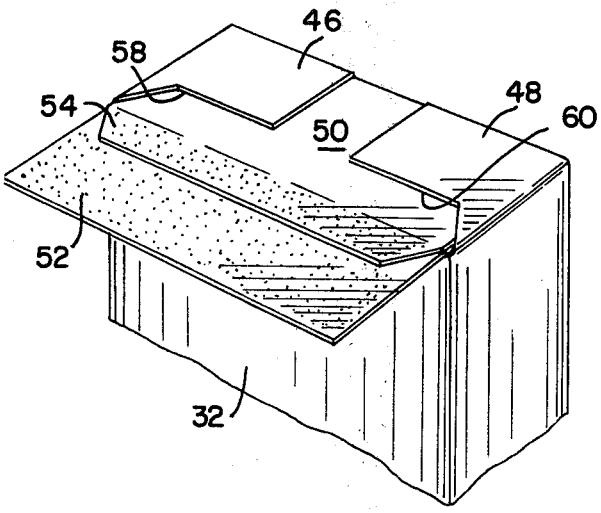
Figure 8:
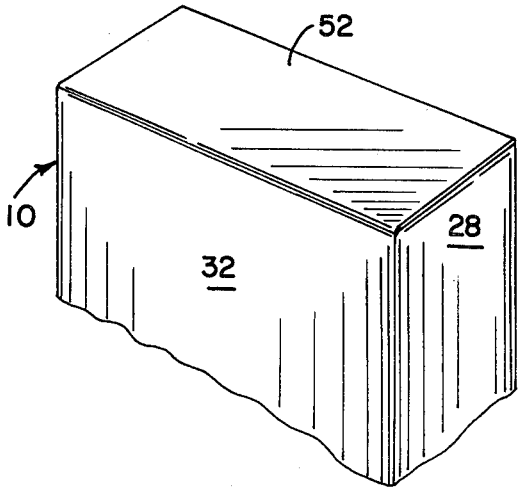
Figure 9:
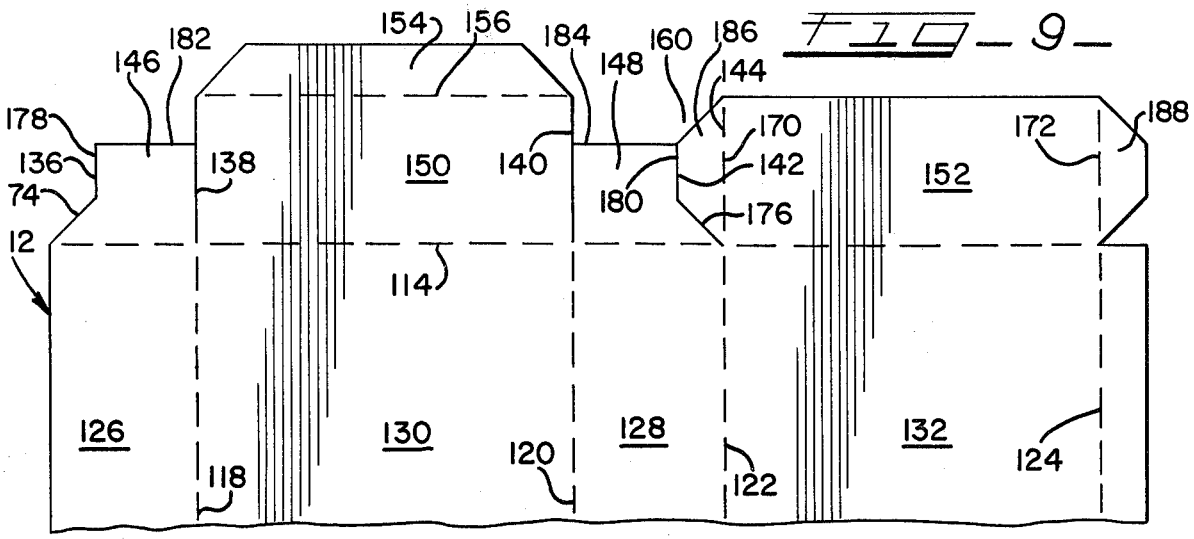
Figure 10:
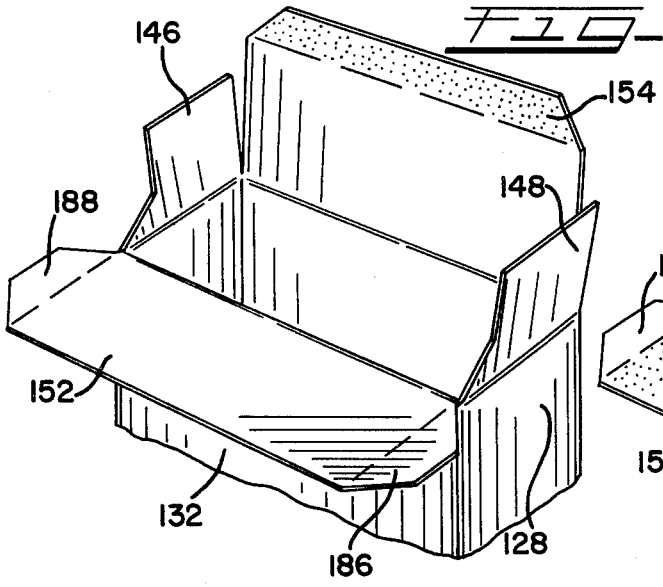
Figure 11:
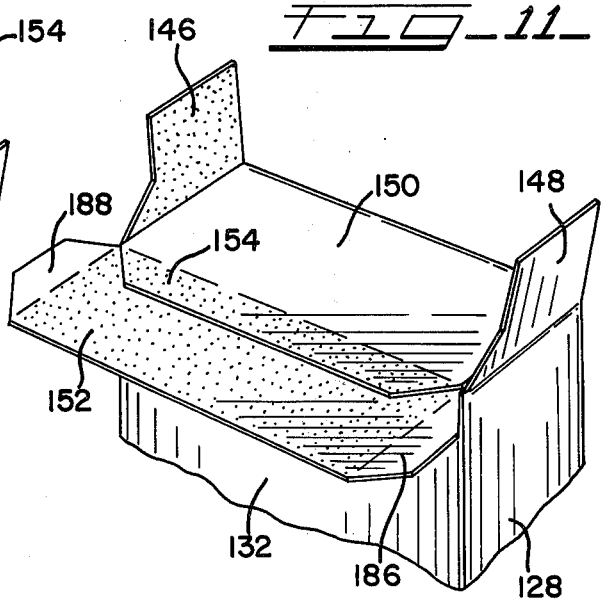
Figure 12:
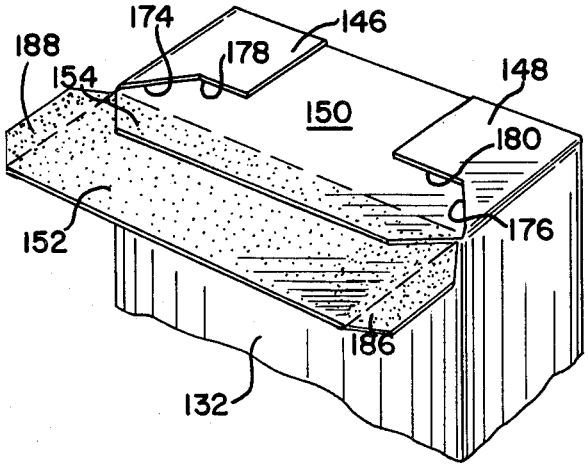
Figure 13:
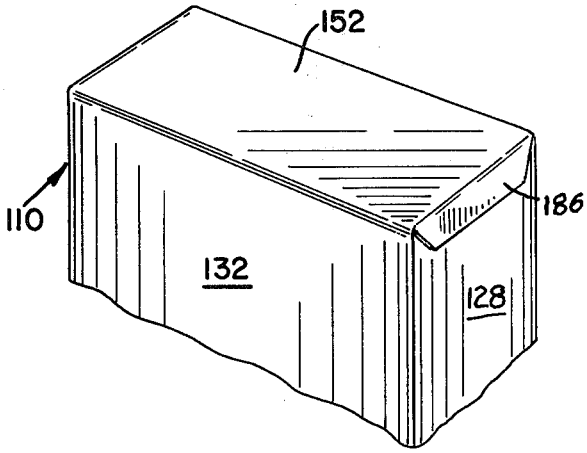

FIGS. 6, 7, and 8 are fragmentary perspective views, similar to FIG. 5, showing the successive steps in closing the end panels on the carton of FIG. 1;

FIG. 9 is a partial plan view showing the inside face of a blank which is cut and scored for fabricating a modified form of the carton which embodies the invention;

FIG. 10 is a fragmentary perspective view showing the top end portion of the modified carton with the end panels in open position; and FIGS. 11, 12, and 13 are fragmentary perspective views, similar to FIG. 10, showing the successive steps in closing the end panels on the modified carton.

The carton structure which is illustrated in the drawings is formed from a blank of suitable foldable sheet material, for example, paperboard, the exact weight and character of which will be dictated, at least in part, by the characteristics of the product which is to be enclosed in the carton.

Figure 4:
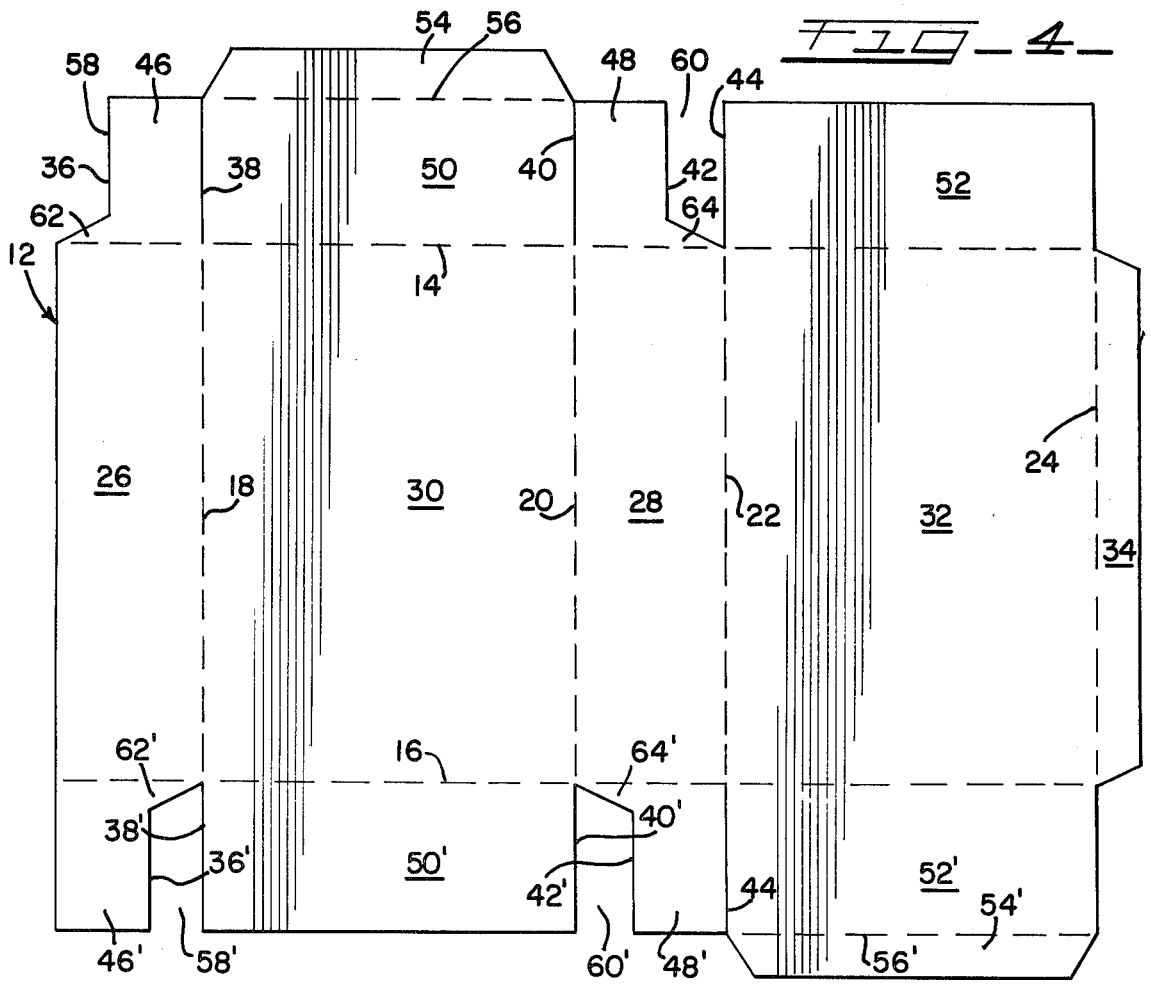
FIG. 4 is a plan view showing the inside face of a blank which is cut and scored for fabricating the carton of FIG. 1.

The carton 10 which is shown in FIG. 1 is formed from foldable sheet material, such as a rectangular blank 12 of paperboard stock of suitable weight or gauge which is cut and scored to provide hingedly related or foldable, integrally connected panels, as shown in FIG. 4. The blank 12 is divided by laterally spaced parallel score or crease lines 14 and 16 into a central sidewall panel forming section and end closure panel forming sections extending along opposite sides thereof. The center section of the blank which extends between the longitudinal score lines 14 and 16 is subdivided by parallel, longitudinally spaced, transverse score lines 18, 20, 22, and 24 into a pair of relatively narrow sidewall forming panels 26, 28, a further pair of sidewall panels 30, 32 of greater width or dimension in the lengthwise direction of the blank and a narrow glue panel 34 at the one end of the blank. The side sections of the blank are cut to provide similar panels which cooperate in forming the end closures in the carton 10. These end closure panel sections are divided by cutting on the lines 36, 38, 40, 42, 44 and 36', 38', 40', 42', 44' so as to form a pair of dust flaps 46, 48 extending laterally of the blank at one end of the narrow sidewall panels 26, 28, a like pair of dust flaps 46', 48' extending at the opposite ends of these panels in reverse relation in the direction longitudinally of the blank, and pairs of rectangular end closure panels 50, 52 and 50', 52' at opposite ends of the wider sidewall forming panels 30, 32. The end closure forming panels 50' and 52' are of identical size and shape and have narrow glue panels 54, 54' extending along the side edges thereof which are separated therefrom by hinge forming crease lines 56, 56' and which are of the same width. The panels 50, 52 and 50', 52' are rectangular and have a width, or a dimension in the direction laterally of the blank, which corresponds to the width, or the dimension lengthwise of the blank, of the sidewall forming panels 26, 28. The dimension of these panels in the direction lengthwise of the blank corresponds to the dimension, in the same direction, of the sidewall forming panels 30, 32 from which they extend. The dust flaps 46, 48 and 46', 48' are cut on the lines 36, 42 and 36', 42' so as to provide notched out areas 58, 60 and 58', 60' which have a width corresponding to the width of the glue panels 54, 54' and which are disposed on opposite sides of the flaps 46, 48 and 46', 48'. The cutting on lines 36, 42, 36' and 42' results in a hinged connection of the dust flaps 46, 48 and 46', 48' with the end edges of the associated wall forming panels 26 and 28 which extends the full width of panels 26, 28 and in triangular connecting web formations 62, 64 and 62', 64' at the hinge lines.

In forming the carton a suitable adhesive is applied to the outside face of the glue flap 34 and the blank is folded so as to engage the glue flap 34 with the free margin of the inside face of the wall panel 26 either on a folding mandrel or in flattened condition for subsequent opening into tubular form. Generally, one end will be closed on a mandrel and the carton will be filled with the product through the opposite end followed by closing of the filling end. The end panels are folded into closed position in an identical manner and the closing steps for one end only will be described. The outside closure panel 52 may be folded back into a plane normal to the plane of the sidewall panel 32. A suitable adhesive is applied to the inside face of the glue panel 54 and the inside closure panel 50 may then be folded in across the open end of the carton (FIG. 6) so as to bring the glue panel 54 into engagement with the margin of the panel 52 which adjoins the hinged connection with the associated sidewall forming panel 30. An adhesive is applied to the inside face of the panel 52 and to the exposed face of the glue panel 54 which is secured thereon after which the panel 52 is swung into engagement with the exposed face portions of the dust flaps 46, 48 and closure panel 50. The notched out areas 58, 60 in the dust flaps 46, 48 permit the glue panel 54 to engage and lie on the top surface of the inner closure panel so as to be secured thereto and provide a tight seal while the triangular portions 62, 64 of the dust flaps 46, 48 at the hinged edges of the flaps insure a tight seal at the corners. The folding and adhesive applying sequence may be varied somewhat and heat sealing material may be used if desired. The forming, closing and sealing operations may be performed on generally available carton machinery with minimum modifications of the machinery.

Another form of the carton 110 (FIG. 13) is illustrated in FIGS. 9 to 13 of the drawings, wherein elements which correspond to elements shown in the form of the carton illustrated in FIGS. 1 to 8 are identified by the same numerals plus 100. Referring first to FIG. 9, the blank 112 is divided by transversely spaced, parallel, longitudinal score lines, only one such score line 114 being shown in FIG. 9, and by parallel, longitudinally spaced score lines 118, 120, 122, and 124 into rectangular, body forming, narrow sidewall panels 126, 128 and body forming sidewall panels 130, 132 of greater width, with a narrow panel 134 extending along an edge of panel 132 for use in connecting the sidewall panels 126 and 134 so as to form a tubular body. Side sections of the blank, which are disposed outboard of the longitudinal score lines, are cut and scored to provide end closure panels of identical character. Only one such side section, which is outboard of the score line 114, is illustrated in FIG. 9. Longitudinally spaced transverse cutting lines 138 and 140, which are aligned with score lines 118 and 120, define opposite ends of an inner end closure panel 150 which has a narrow panel 154 extending along its outboard edge and separated therefrom by score line 156, the latter extending parallel with score line 114 and spaced therefrom a distance corresponding to the distance between the transverse score lines 120 and 122 which define opposite edges of the narrow sidewall panel 128. The transverse score lines 122 and 124 are extended outboard of the score line 114 and the score line extensions 170 and 172 define between them an outer closure panel 152. The material in the blank side section which extends outboard of the ends of the narrow sidewall forming panels is cut on transversely extending lines 136 and 142, as shown, to form dust flaps or panels 146 and 148. The cutting lines 136 and 142 extend at their innermost ends from the intersection of the longitudinal score line 114 with the blank transverse edge 112 and score line 122, respectively, with portions 174 and 176 inclined toward each other and extending to portions 178 and 180 which are parallel with and spaced a predetermined distance from score lines 138 and 140, as shown. The cutting line portions 178 and 180 extend to lines 182 and 184 which are parallel with the score line 114 and which define the terminal edges of the flaps 146 and 148. The material in the area between the cutting line 142 and the score line extension 170 is cut so as to form a truncated cone shaped ear forming flap or panel 186 with the score extension line 170 forming the base on which the ear 186 is adapted to be folded. A corresponding ear element 188 of identical size and configuration is cut at the opposite end of the panel 152 with the score line extension 172 forming the base on which the ear element or panel 188 is adapted to hinge. The panel 154 has a width which corresponds to the width of the space between the cutting line 180 and the score line extension 170 and its opposite ends are cut on diagonal lines converging toward each other so as to lie along the edge portions 174 and 176 of the flap elements 146 and 148 when the end panels are folded into the closed position, as hereinafter described.

The end closure formed with the blank 112 of FIG. 9 is obtained by employing the adhesive application and panel folding steps illustrated in FIGS. 11 to 13, the inside flap or closure panel 150 is swung into end closing position which brings the adhesive coated panel 154 into engagement with the outturned outside closure panel 152 (FIG. 11) and the adhesive coated dust flaps 146 and 148 are turned down on the exposed face of the panel 150 (FIG. 12). The exposed surfaces of the outside closure panel 152 including the ear forming flaps or panels 186, 188, and the panel 154 are coated with adhesive after which the closing is completed by hinging the panel 152 to the closed position, overlying the outside panels and the ears 186, 188 are folded down onto the top margins of the panels 126 and 128 (FIG. 13). The ear forming panels 186 and 188 use otherwise wasted material to form a further seal at the ends of the panels.

I claim:

1. A carton structure formed from a blank of foldable sheet material which is cut and scored so as to provide, when set up and closed, a tubular body of generally rectangular cross section comprising hingedly connected pairs of oppositely disposed sidewall forming panels and an end wall forming structure which includes end flaps hinged to oppositely disposed end edges of a pair of said sidewall panels and rectangular inner and outer end closure panels of substantially equal size which are hinged to oppositely disposed end edges of the pair of said sidewall panels extending between the first mentioned sidewall panels, said end flaps being secured between said inner and outer end closure panels, which end closure panels are of a size to substantially fill the end opening of said tubular body and the innermost one of said closure panels having a small, relatively narrow panel extending in hinged relation along the free edge thereof which is opposite the hinged connection of said end closure panel with the associated sidewall panel, said small panel being adhesively secured to the inside margin of the outermost end closure panel, and extending along the hinged connection of said outermost end closure panel with its associated sidewall panel, said end closure flaps and said small marginal panel being disposed so as to lie on the outermost face of said innermost end closure panel and in a common plane therewith between said innermost and outermost end closure panels with the opposite faces thereof adhesively secured to the faces of said end closure panels, said end closure flaps have portions cut out of the side margins thereof which are adjacent the hinged connection of said outermost end closure panel with its associated end wall panel, and said small marginal panel being of a size and configuration to substantially fill the areas resulting from the cut out portions of said end closure flaps, said end closure flaps have their inner edges terminating short of engagement with each other so as to expose a portion of the innermost end closure panel's surface for adhesive engagement by the outermost end closure panel, said outermost end closure panel including small integral ear forming tab members extending in hinged relation along the opposite ends thereof which are folded into engagement with and adhesively secured to the outside face of said sidewall forming panels which have said hinged end closure flaps, whereby said carton end wall forming structure includes at least two thicknesses of material which is adhesively secured so as to fully close the carton end with each end edge of the carton sealed along the length thereof by an integral hinge area.

2. A blank of paperboard or similar foldable sheet material for forming a tubular carton, which blank is cut and scored to divide it into a plurality of hingedly connected sidewall and end closure forming panels, said blank being scored on laterally spaced longitudinally extending lines and on longitudinally spaced transversely extending lines so as to define pairs of generally rectangular sidewall forming panels and a relatively narrow glue flap at one end of the blank for connection to the margin of the panel at the other end of the blank, side marginal portions of said blank which are outboard of said laterally spaced longitudinally extending lines being cut on lines extending from the ends of said transversely extending lines so as to form on opposite ends of each sidewall forming panel end closure forming panels, said end closure panels being in paired, interspaced relation on each side of the blank with the panels of each pair being of corresponding dimensions, one pair of said end closure panels at each of said opposite sides of said blank being cut away at the transverse margins which are remote from each other and forming outwardly opening areas of predetermined width, said cut away areas being arranged so as to align with each other when the carton is formed and said end closure panels are folded into end wall forming relation, the associated pair of said end closure panels at each side of said blank being of corresponding dimensions and one thereof having a relatively narrow glue flap forming strip extending along its outermost margin which has a width corresponding to the width of said cut away areas, said glue strips being divided by hinge forming score lines from said pair of closure panels which are diagonally opposite each other, the other one of said associated pair of said end closure panels having truncated triangular tab members extending from opposite ends thereof, one of which is taken from the material in said cut away area of the one of said associated pair of said end closure panels which adjoins the same.

* * * * *